US005791251A

United States Patent [19]

Kistler et al.

[11] Patent Number: 5,791,251

[45] Date of Patent: Aug. 11, 1998

[54] METHOD OF REGULATING INK-FEEDING OR INKING IN PRINTING

[75] Inventors: Bernd Kistler, Eppingen; Nikolaus Pfeiffer, Heidelberg; Manfred Schneider, Bad Rappenau, all of Germany

[73] Assignee: Heidelberger Druckmaschinen AG, Heidelberg, Germany

[21] Appl. No.: 639,423

[22] Filed: Apr. 29, 1996

[30] Foreign Application Priority Data

Apr. 27, 1995 [DE] Germany ..... 195 15 499.1

[51] Int. Cl.[6] ..... B41F 31/00

[52] U.S. Cl. ..... 101/484

[58] Field of Search ..... 101/365, DIG. 47, 101/DIG. 45, 484, 183; 364/526, 551.01, 571.01; 356/429, 394, 425, 407, 406; 250/559.01, 559.04, 559.2, 559.39

[56] References Cited

U.S. PATENT DOCUMENTS 5,182,721 1/1993 Kipphan et al. .
5,530,656 6/1996 Six ..... 364/526

FOREIGN PATENT DOCUMENTS 0 142 470 A1 5/1985 European Pat. Off. .
0 228 347 7/1987 European Pat. Off. .
0 142 470 B1 1/1988 European Pat. Off. .

*Primary Examiner*—J. Reed Fisher
*Attorney, Agent, or Firm*—Herbert L. Lerner; Laurence A. Greenberg

[57] ABSTRACT

Method of regulating inking when printing is performed with more than three printing colors, which includes comparing, in a control, actual value color locations derived from a color measuring arrangement with reference value color locations in a given user color space; deriving control signals from the attained comparison values, in accordance with a predetermined relationship, for an inking device containing ink distribution devices which influence the thickness of a layer of printing ink applied zonally in the form of halftone dots or solid full-tone areas to a material to be printed; and further deriving the actual value color locations from measurement locations in the printed image. When printing with n printing colors wherein n is greater than 3, deriving the actual value color locations from measurement locations of at least (n−2) regions, wherein vectors of area coverage of all of the n printing colors involved are, respectively, linearly independent of one another.

5 Claims, 3 Drawing Sheets

METHOD OF REGULATING INK-FEEDING OR INKING IN PRINTING

BACKGROUND OF THE INVENTION

Field of the Invention

The invention relates to a method of regulating ink-feeding or inking in printing, and more particularly, wherein the printing is performed with more than three printing colors, which includes comparing, in a control, actual value color locations derived from a color measuring arrangement with reference value color locations in a given user color space, deriving control signals from the attained comparison values, in accordance with a predetermined relationship, for a color device containing ink distribution devices which affect the layer thickness of the printing ink applied zonally, in the form of halftone dots or solid full-tone areas to a material to be printed; and further deriving the actual value color locations from measurement locations in the printed image.

In heretofore known systems for regulating color, color measuring devices are used which furnish three color values per measurement location, these values being expressable in a given calorimetric system. In order to be able to make some statement, in printing, regarding how much the color valence at the measurement location deviates from a desired color valence, valence-metric colorimetric measures are derived from the color values. Various color difference formulas are in use which enable the calculation of color difference based upon the valence-metric calorimetric measures. To regulate the ink-feeding or inking, color spaces are conventionally used in printing technology, wherein a good match between the geometrical and the perceived color difference exists. These approximated color spaces, which are perceived to differ equally, are designated as L*a*b* color space CIE 1976 or as L*u*v* color space CIE 1976.

The valence-metric colorimetric measures of such color spaces perceived to be of equal difference can always be ascribed, via inversely unequivocal mathematical relationships, to the measured color values, or converted into other color spaces.

As a rule, the controlled variables are referenced to a color space wherein quality evaluation also takes place. Therefore, each color space requires its own or an adapted, i.e., matching, control algorithm.

In practice, one color value per color zone is ascertained at a given measurement location for each of the printing inks involved. Especially suitable measurement locations in the printed image are selected, which are printed with the image, for example, in so-called color or print control strips in special measurement fields, and evaluated.

The published European Patent Document EP 0 142 470 A1 shows how the control or actuating variables can be ascertained for each individual printing zone for automatically controlling the color guide devices in a printing press. In this disclosure, a comparison of reference remission values and actual remission values is performed in a printing zone at many measurement locations. The reference remission values and actual remission values are multiplied, before the comparison, by factors which describe a measure of perception for color deviations and the influence of the full-tone density on the remission. The deviations between the reference and actual values are added up over the applicable printing zone and, if necessary or desirable, are averaged arithmetically.

In the solutions offered in the prior art, in order to achieve high accuracy, the greatest possible number of measurement locations must be selected, and the aforementioned evaluation and calculation methods must be employed thereto. Particularly during the ongoing operation at a high printing speed, when almost every sheet of paper should, if at all possible, be measured, a considerable amount of data is produced, which cannot be processed, or can be processed only with great effort and at great expense.

In the method of ink application control disclosed in the published European Patent Document EP 0 228 347 A1, the controlling variables for the basic colors involved in the printing, namely, cyan, magenta and yellow, for the printing ink black and for special colors, respectively, are derived independently of one another. Actual remission values for multicolor matrix fields are used for the basic colors. For the black printing ink and the special colors, separate full-tone or solid fields are provided. For the black printing ink, it is also possible to provide an IR sensor, which furnishes the actual remission values for the black printing ink. The provision of special measuring fields or additional sensors involves additional effort and expense.

Control of the color guidance is effected based upon color differences between the actual color locations and reference color locations in a given color space. It is possible for a total color difference to be obtained from individual color differences in test regions having overlapping zones, a weighting of the individual color differences being performable, so that, for example, regions typical for a particular image are given a greater weight.

In controlling more than three printing colors while using four color matrix fields, one color must be predetermined as a free parameter or must be measured additionally on a separate field.

SUMMARY OF THE INVENTION

It is accordingly an object of the invention to provide a method of regulating ink-feeding or inking in printing, which reduces the effort and expense for calculation and for color sensors and assures highly dynamic regulation.

With the foregoing and other objects in view, there is provided, in accordance with the invention, a method of regulating inking when printing is performed with more than three printing colors, which includes comparing, in a control device, actual value color locations derived from a color measuring arrangement with reference value color locations in a given user color space; deriving control signals from the attained comparison values, in accordance with a predetermined relationship, for a color device containing ink distribution devices which influence the thickness of a layer of printing ink applied zonally in the form of halftone dots or solid full-tone areas to a material to be printed; and further deriving the actual value color locations from measurement locations in the printed image, which comprises, when printing with n printing colors wherein n is greater than 3, deriving the actual value color locations from measurement locations of at least (n–2) regions, wherein vectors of area coverage of all of the n printing colors involved are, respectively, linearly independent of one another.

In accordance with another mode, the method according to the invention includes, when printing with printing colors cyan, magenta, yellow and black, selecting two regions for deriving the actual value color location, black being dominant in one of the regions, and one of the printing colors other than black being dominant in the other of the regions.

In accordance with a further mode, the method according to the invention includes, when printing with printing colors cyan, magenta, yellow and black and at least one further special color, selecting a new region, respectively, wherein the one special color is dominant, for deriving the respective actual value color location.

In accordance with an added mode, the method according to the invention includes, when printing with printing colors cyan, magenta, yellow and black and a plurality of other special colors, selecting new regions, respectively, wherein each of the other special colors is dominant, for deriving the respective actual value color locations.

In accordance with an additional mode of the method according to the invention, the derivation of the actual value color locations is from measurement locations of at least (n–2) regions, wherein vectors of area coverage of all of the n printing colors involved are, respectively, linearly independent of one another and substantially orthogonal to one another.

In accordance with a concomitant mode, the method according to the invention includes, for each zone, deriving the actual value color locations from a multiplicity of measurement locations in a color space which is linear for the additive color mixture; assigning the actual value color locations to at least one region in the printed image wherein the respective printing color to be controlled is dominant; multiplying the number of actual value color locations in the color space, which is linear for the additive color mixture, by a factor resulting from a partial derivation of the color locations, to form a color space which is perceptibly of equal difference; forming a mean value of the corrected actual value color locations for each region and the respective printing color to be controlled; performing a comparison of the mean value of the corrected actual value color locations, for each region, with predetermined mean values of reference value color locations for the same measurement locations, the reference value color locations having likewise been multiplied by the factors; and deriving from the resultant comparison values, the control signals for the color distribution devices of each printing color.

It is possible, with the invention, particularly when black and special colors are to be controlled or regulated in addition to the basic colors cyan, magenta and yellow, to derive the control signals for each printing color and each zone quickly.

Regulation or control of ink-feeding or inking can be performed for each arbitrary color space. For each measurement location region, the actual value color locations can be advantageously multiplied by correction factors, in the form of a distortion vector which can be formed of partial divisions or compartments of the color coordinates of the color space used for the quality evaluation, in accordance with the color coordinates of the color space to which the control algorithm is referred.

An advantage is thereby gained that the regulation or control always takes place in the color space which is optimal therefor; the result of regulation or control in the color space selected for the quality evaluation is optimal. When some other color space used for quality evaluation is selected, only the distortion vectors need to be re-determined. The control algorithm remains unchanged in the color space used for the control or regulation. In the color space wherein the control or regulation proceeds, averaging the corrected actual value color locations can be performed without error.

Because of the regional averaging, the number of reference and actual values for the regulation/control is very low, yet many measurement locations are included in the regulation/control. Because the control algorithm has to be carried out only once per zone, brief signal processing times result.

The method has the advantage that, for a large number of measurement fields, the positioning accuracy of the color distribution devices or of the receivers which they contain, with respect to the printed image, do not impair the regulating or control accuracy.

If the printing ink black is to be controlled/regulated together with the three basic colors cyan, magenta and yellow in the image, then Neugebauer's equations and their derivations, for example, must be applied to four colors. The result is a linear system of equations which, when solved, allows derivation of the control values for the color distribution devices. The measurement locations for regulating/controlling the basic colors cyan, magenta and yellow and the measurement locations for regulating/controlling the printing ink black need not be located spatially together. The measurement locations are assigned to regions wherein at least one region contains much of the printing ink black and at least another region containing only a little black. The two regions are thus linearly independent of one another. In the event that there is a region in the printed image wherein only the printing ink black is present, for example, when writing, i.e., printing characters, is printed, then this region can be regulated or controlled by single-color regulation/control. The layer thickness change then calculated for the printing ink black should also be used as an input variable for determining the control signals for the remaining printing colors.

If special colors are printed, in addition, then for each special color, one region can be formed wherein this color exists, either advantageously alone or predominantly. The layer thickness variation for these regions can be derived, as described hereinabove, for the printing ink black, by means of averaging and single-color regulation or control. If the special colors are printed in the image in addition to the printing-ink colors black, cyan, magenta and yellow or, in other words, in the matrix together with other color-s, then Neugebauer's equation and its derivation, for example, must be expanded accordingly. If regions exist wherein the special colors alone are present, then the special color regulation or control is expediently performed in these regions. These layer thickness variations then enter, as input variables, into the linear equation system of the remaining image. If no regions exist wherein the special colors alone appear, then a new region must be formed for each of the special colors, analogously to the procedure for the printing ink black. The result then is a plurality of independent equations which can be solved.

If n colors are present alone in the printed image and m colors are printed in the matrix, then n regions should be selected for single-color regulation or control and (m–2) regions should be selected for multicolor regulation or control.

If more regions are used than are necessary for the regulation or control, for example, if a grey field region and three full-tone or solid-area field regions are used in three-color regulation or control, then when the regulation or control data contradict one another, such as, for example, the recommended regulation or control in the grey field region is other than that in the full-tone field regions, optimizing methods are employed. For example, weighting of the measurement locations and of the sensitivities can be used.

Other features which are considered as characteristic for the invention are set forth in the appended claims.

Although the invention is illustrated and described herein as embodied in a method for regulating ink-feeding or inking in printing, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF PREFERRED EMBODIMENTS

Figure 1:
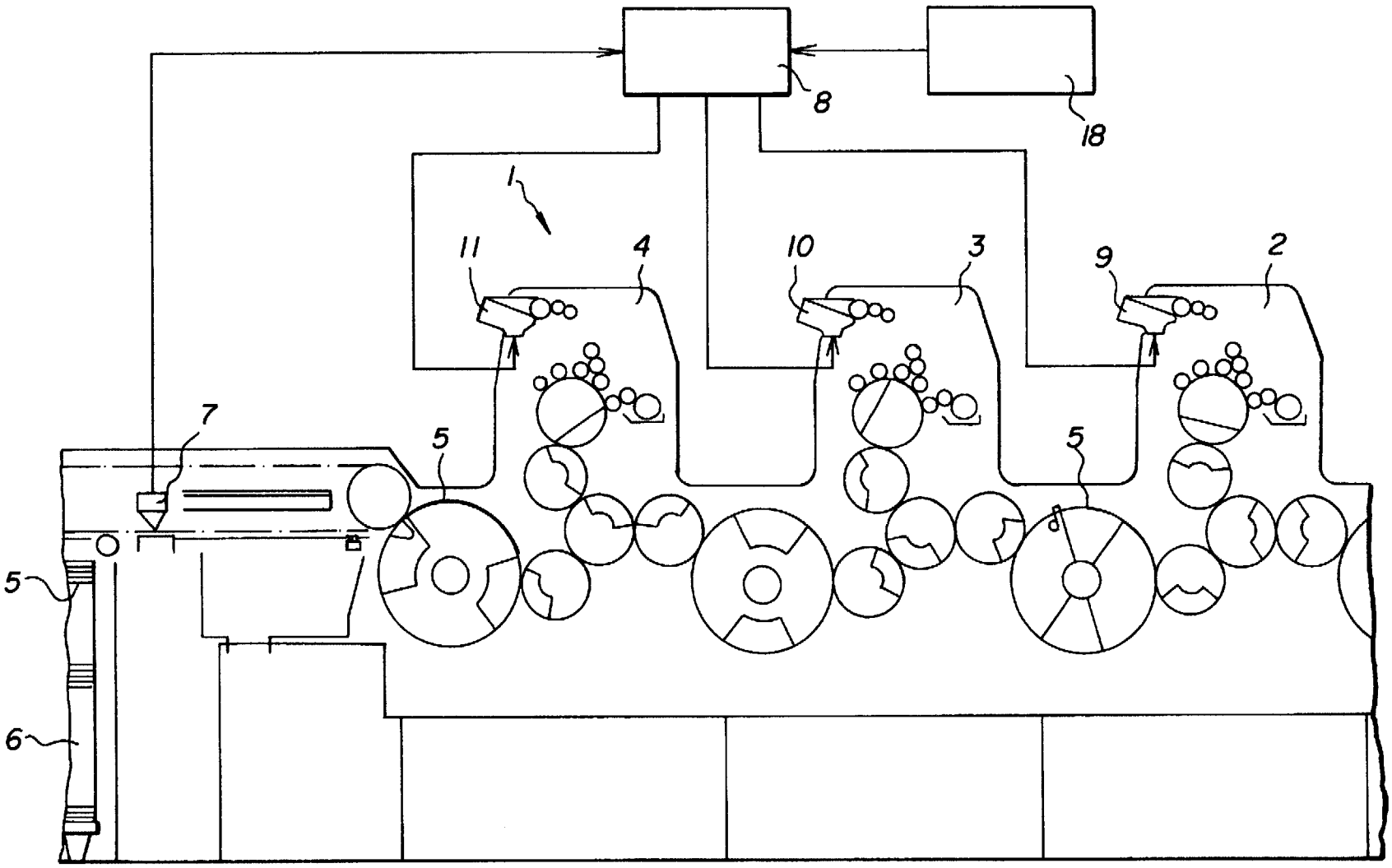
FIG. 1 is a diagrammatic and schematic view of a printing press with devices for performing the method of regulating ink-feeding or inking in printing, in accordance with the invention.

Referring now to the drawings and, first, particularly to FIG. 1 thereof, there is shown therein an offset printing press 1 which includes printing units 2, 3 and 4, disposed in tandem or series, for multicolor matrixlike printing on top of one another on sheets of paper 5. In a transport path of the sheets 5, a color measuring arrangement 7, which is able to detect the entire surface of the sheets, is provided between the last printing unit 4 and a sheet pile 6, and is connected to a control 8, such as a suitable computer. The control 8 is also connected to ink distribution devices 9, 10 and 11, via control elements of which the layer thickness of the printing ink applied zonally to the sheets 5 are variable.

Figure 2:
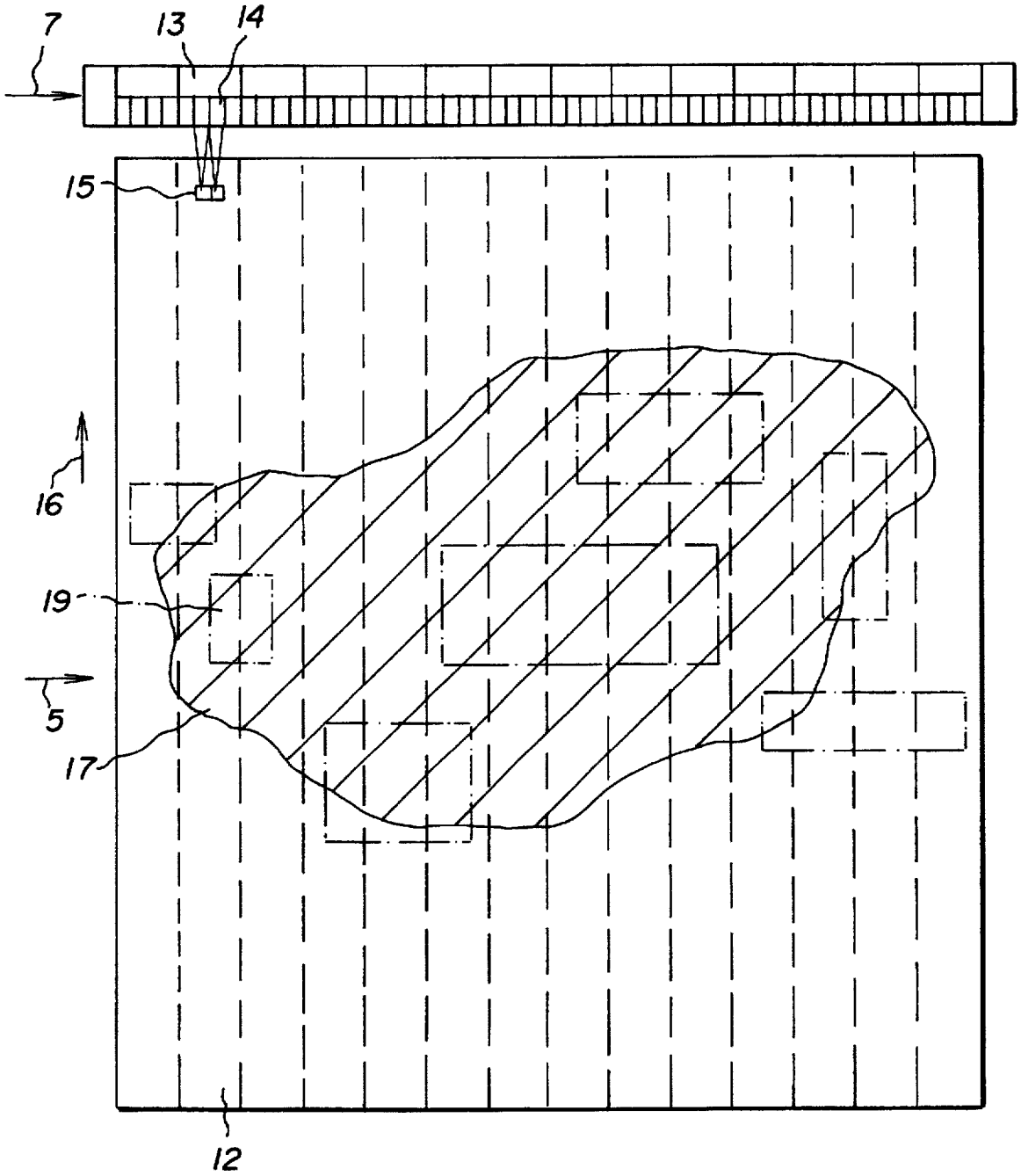
FIG. 2 is a plan view of a printed sheet with regions for controlling a given printing color.

As is apparent from FIG. 2, the application of ink takes place in zones 12, the boundaries of which are suggested by the broken lines on the sheets 5. A modular color measuring arrangement 7 is assigned to the zones 12, and each module 13 encompasses one zone 12. Located in each module 13 are photoelectric receivers 14, which generate picture signals from measurement fields 15. When the sheet 5 is moved in the direction represented by the arrow 16 past the color measuring arrangement 7, signals occur at the output of the color measuring arrangement 7, which represent the entire surface area of the sheet 5. The dimensions of a measurement field are considerably smaller than the width of a zone 12; for example, measurement fields with dimensions of 0.8×0.8 mm are typical for the method of color or inking control/regulation. Except for a printed image 17, there are no other elements, such as print control strips or register crosses, on the sheets 5.

The method of regulating or controlling ink-feeding or inking can be performed with this arrangement as follows:

The objective of the control or regulation is to obtain a printed sheet 5 having an inking which is maximally close to the inking of an OK sheet 5. The picture data of such an OK sheet 5 are available in a reference value transmitter 18. The printed image 17 is divided into regions 19 wherein one printing color to be controlled is dominant. When the three basic colors cyan, magenta, and yellow along with the printing ink black and a special color are printed, at least one region 19 is present wherein the basic colors cyan, magenta and yellow are dominant. There is also at least one region each wherein the printing ink black and the special color, respectively, are dominant.

When a sheet 5 moves past the color measuring arrangement 7, picture signals are produced from which color values for each measurement field are derived in the control 8. From the color values, calorimetric measures are calculated in a color space, wherein linearity exists for the additive color mixture.

In a further step, for each predetermined region 19 and the respective printing color to be controlled, the actual value color locations are multiplied by correction factors, and the mean value of the corrected actual value color locations is formed. The correction factors are produced from the derivations of the color locations in the color space which is linear for the additive color mixture, for example, an L*a*b* or L*u*v* color space, for instance, which is perceived to be of equal difference. Then, these mean values are compared with mean values of the reference value color locations for each region 19 and the respective printing color to be controlled. In the control 8, the control signals for the control elements of the color distribution devices 9, 10 and 11 are derived From the comparison values and fed to the control elements.

Figure 3:
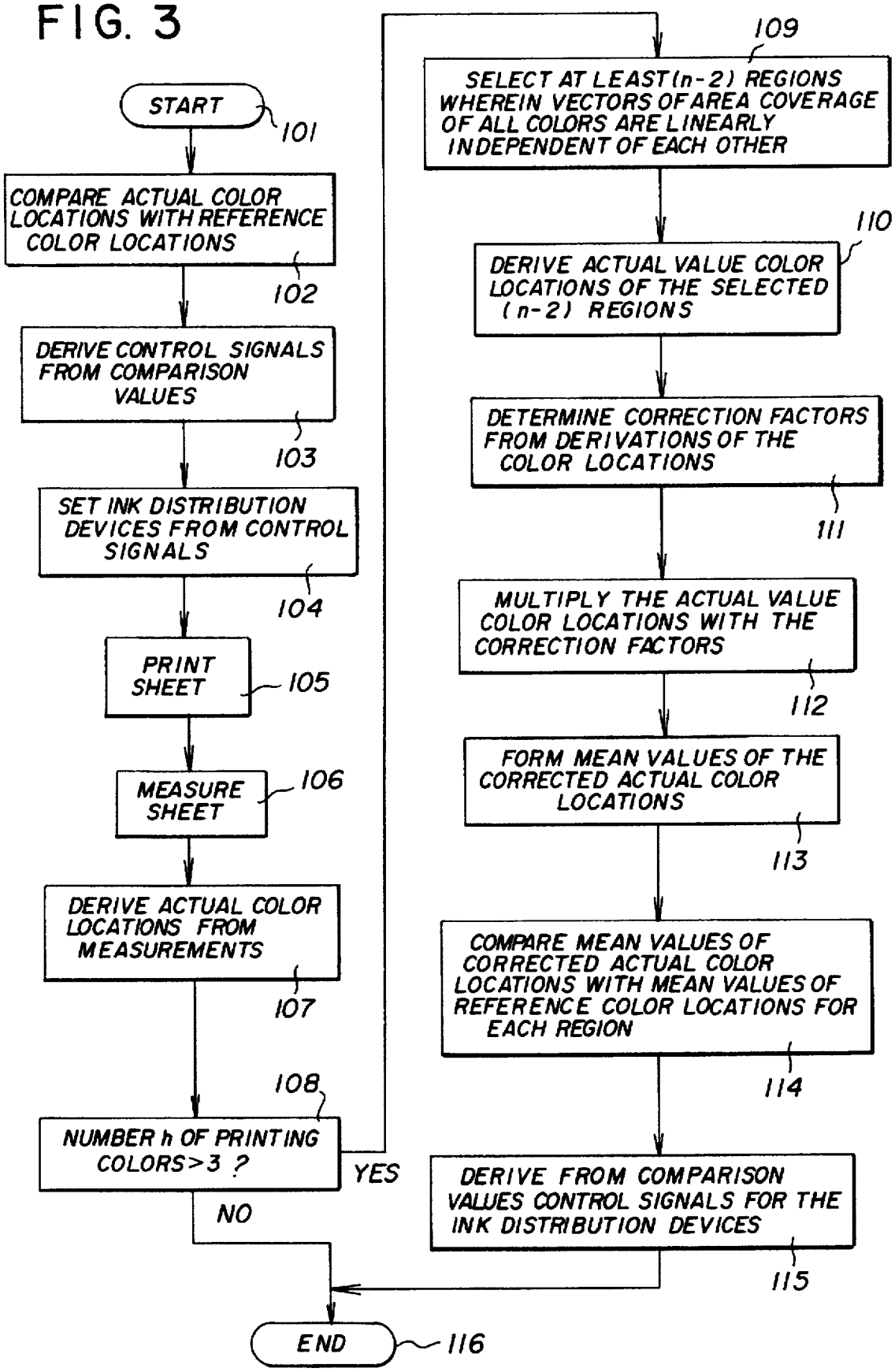
FIG. 3 is a flow chart showing the steps to be performed by the central device according to the invention.

FIG. 3 is a flowchart showing the steps to be performed by the control device 8 in deriving control signals for the ink distribution devices 9, 10 and 11 of the printing machine.

After start 101 the actual color locations are compared in step 102 with the reference color locations from reference value transmitter 18. In step 103, control signals are derived from the comparison values, and in step 104 the ink distribution devices are set with the control signals. In step 105 a sheet is printed with the ink distribution signals according to step 104, and the printed image is measured in step 106, and the actual printed color locations are derived in step 107 from the measurements.

In case the number n of the printing colors used is greater than 3 in step 108, at least (n−2) regions 19 of the image 17 are selected in step 109 so that in each region the vectors of the area coverage of all colors are linearly independent of each other. In step 110 actual color locations of the selected (n−2) regions are derived. Next, in step 111, correction factors are determined from the derivations of the color locations, and in step 112 the actual color location values from step 110 are multiplied with the correction factors. In step 113 mean values of the corrected actual color locations are formed, and next, in step 114 the mean values of the corrected actual color locations are compared with the mean values of the reference color locations for each region 19. Next in step 115 control signals for the ink distribution devices are derived from the comparison values, and the process is completed in step 116.

We claim:

1. Method of regulating inking when printing is performed with more than three printing colors, which includes comparing, in a control, actual value color locations derived from a color measuring arrangement with reference value color locations in a given user color space; deriving control signals from attained comparison values, in accordance with a predetermined relationship, for regulating an application of ink by an inking device containing ink distribution devices which influence the thickness of a layer of printing ink applied zonally in the form of halftone dots or solid full-tone areas to a material to be printed; and further deriving the actual value color locations from measurement locations in the printed image, the method which comprises, printing with n printing colors wherein n is greater than 3, deriving the actual value color locations from measurement locations of at least n−2 regions, wherein vectors of area coverage of all of the n printing colors involved are, respectively, linearly independent of one another.

2. Method according to claim 1, which includes, printing with printing colors cyan, magenta, yellow and black, selecting two regions for deriving the actual value color location, black being dominant in one of the regions, and one of the printing colors other than black being dominant in the other of the regions.

3. Method according to claim 2, which includes, printing with printing colors cyan, magenta, yellow and black and at least one further special color, selecting a new region, respectively, wherein the one special color is dominant, for deriving the respective actual value color location.

4. Method according to claim 2, which includes, printing with printing colors cyan, magenta, yellow and black and a plurality of other special colors, selecting new regions, respectively, wherein each of the other special colors is dominant, for deriving the respective actual value color locations.

5. Method according to claim 1, wherein the derivation of the actual value color locations is from measurement locations of at least n−2 regions, wherein vectors of area coverage of all of the n printing colors involved are, respectively, linearly independent of one another and substantially orthogonal to one another.

* * * * *